United States Patent [19]

Bocchi

[11] Patent Number: 4,838,450

[45] Date of Patent: Jun. 13, 1989

[54] CONTAINER DESIGNED FOR FIZZY DRINKS AND MADE OF HEAT-MOULDED PLASTIC MATERIAL

[76] Inventor: Luigi Bocchi, via dei Cignoli, 1, 20151 Milano, Italy

[21] Appl. No.: 66,856

[22] Filed: Jun. 25, 1987

[30] Foreign Application Priority Data

Jul. 3, 1986 [IT] Italy ..... 21022 A/86

[51] Int. Cl.[4] ..... B65D 43/03

[52] U.S. Cl. ..... 220/270; 206/508

[58] Field of Search ..... 220/1 BC, 70, 67, 270, 220/266, DIG. 14; 206/508

[56] References Cited

U.S. PATENT DOCUMENTS

| | | | |
|---|---|---|---|
| 2,209,663 | 7/1940 | Riedel | 220/1 BC |
| 2,741,402 | 4/1956 | Sayre | 220/67 |
| 2,894,844 | 7/1959 | Shakman | 220/1 BC |
| 3,279,640 | 10/1966 | Dodson | 206/508 X |
| 3,709,398 | 1/1973 | Fuhrmann | 220/67 |
| 3,942,673 | 3/1976 | Lyu et al. | 220/66 X |
| 4,051,951 | 10/1977 | Smith | 206/508 |
| 4,207,989 | 6/1980 | Ingemann | 220/266 |
| 4,210,618 | 7/1980 | Piltz et al. | 220/270 X |

*Primary Examiner*—Donald F. Norton

*Attorney, Agent, or Firm*—Bucknam and Archer

[57] ABSTRACT

Container designed for fizzy drinks made in heat-moulded plastic material, preferably in polyethyleneterephthalate and provided with a heat-moulded plastic cover heat-sealed to the body of the container, the base (6) and cover (13) of which have a shape which is convex towards the center of the said container. The container can absorb the variations in pressure that the fizzy drink generates in various environmental conditions, and simultaneously, can compensate for the osmotic losses of gas. The container is furthermore provided with a shape (11, 12) of the cover and a shape (4, 5) of the base which allows side-by-side storage of the containers and stacking one above the other in a warehouse, and also the insertion into the cover of an opening device (15, 25) for pull-off or push-down opening.

4 Claims, 2 Drawing Sheets

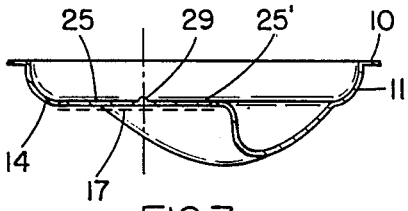
FIG.7
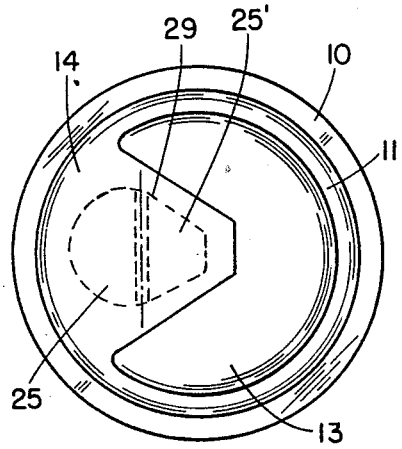
FIG.8
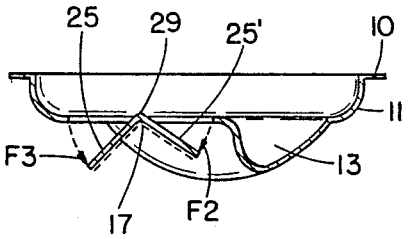
FIG.9
FIG.10
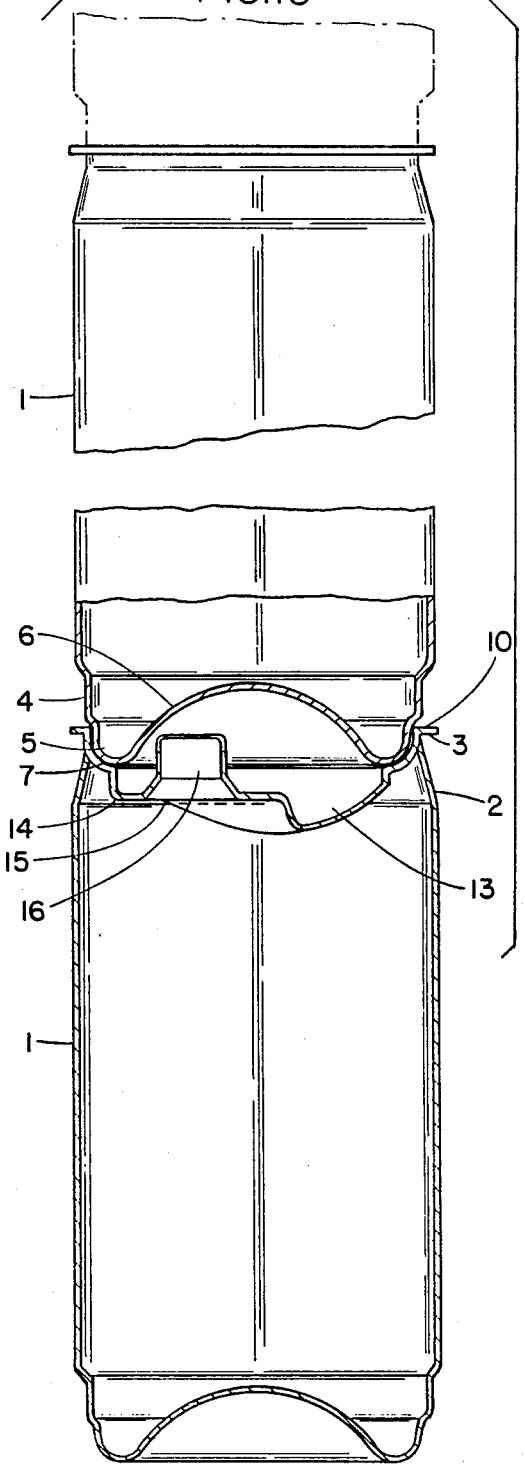

CONTAINER DESIGNED FOR FIZZY DRINKS AND MADE OF HEAT-MOULDED PLASTIC MATERIAL

BACKGROUND OF THE INVENTION

1. Field of the Invention

The present invention consists of a container made of heat-moulded plastic material and designed for fizzy drinks. More paricularly, the present invention concerns a container designed for fizzy drinks; it has a heat-moulded lid which is joined to the body of the container, and which can resist the variations in pressure that the fizzy drink may create in various environmental conditions.

2. Description of the Prior Art

As already known, glass bottles closed with crown caps clamped to the underside of the ring-shaped protruberance on the neck of the bottle are used for the distribution of fizzy drinks. These containers are extremely hygienic and stable, and they satisfy all the requirements of the field, but they have the disadvantage of being fragile, heavy, and expensive. In order to avoid these disadvantages, especially for drinks to be consumed immediately and for single doses, firms have introduced disposable metal containers which are convenient to use, easy to store in a warehouse, and of good appearance, especially those which have tear-off openings with ring-pull levers pressed down on to the lid of the container.

These containers, apart from being relatively expensive, are not free from certain physiological and hygiene risks, or organolectic ones, due to the use of aluminum or thin paint layers polymerized in place, employed especially in containers in iron bands.

Well known also are containers made of thermoplastic material with self-sealed covers made of metal or thermoplastic material. These containers have been widely used to contain drinks and non-fizzy food products in so far as it is possible to produce them in thermoplastic resins suitable for foodstuffs, i.e. resins which do not liberate substances harmful to human health whether on their own account resulting from usual additives such as plastifiers or accelerators added during the production phase. However, their reduced breaking strain under traction and their low modulus of elasticity make it difficult to produce containers in plastic material suitable for fizzy drinks, especially saturated at 25° with 4 $Kg/cm^2$ of $CO_2$, which may increase to 8 $Kg/cm^2$ when, for environmental conditions, one may find temperatures of up to 40° C.

Under these conditions, the material may be placed under an increased strain if one cannot provide an area of expansion so placed that it does not disturb the stability of the individual container and also that of the stored quantities in the warehouse. Furthermore, it is known that, across the thin walls of the thermoplastic material, there is an osmotic migration, particularly of $CO_2$, as a result of the enormous differences of partial pressure of the same above the liquid and in the area surrounding the container. Therefore, $CO_2$ is continually flowing into the environment, so the pressure at the surface of the liquid is reduced.

SUMMARY OF THE INVENTION

The present invention can resolve all the above-mentioned disadvantages by using a container in heat-moulded plastic material in which both the base and the cover have a convex shape. The presence of the convex shape at the base and the cover have the dual purpose of absorbing locally, in areas which create no disturbance, deformations through increase of pressure, and; at the same time, to introduce a gas filled area which compensates for the diffusion from the area above the liquid into the surrounding area of $CO_2$.

The present invention resolves advantageously all of the above-mentioned disadvantages of current containers, eliminating the problems and the costs of glass or metal, making the container in thermoplastic material trustworthy and secure for the manufacturer and the distributors, and comfortable for the user.

The containers of the present invention may be obtained using any of the already known production methods. In particular, bidirectional stretching and moulding are preferable for the production of the container of the present invention. In this way, the containers do not present any signs of localized fragility, they stand up to shocks and bumps, and for this reason the walls function as a safe container for the pressure. Furthermore, according to the present invention, changes in shape and compensation for the pressure are localised, and resolved by the shape of, the base and the cover of the container. These areas are uniformly convex towards the interior and are formed in such a way as to keep the bottom flat (to ensure that the single container stands up safely), whether it is fully distended of partially collapsed; minimal changes of shape of the walls do not interfere with the grouping together of the containers or the fitting of the bottom of one to the top of another for stacking. Furthermore, the particular shape of the cover allows for the placing of a pull-off cap for opening and pouring which is just as safe and just as easy as the metal ring-pull. The constructional and functional characteristics of the container in plastic material of the present invention may be better understood from the following detailed description in which reference is made to the drawings of the figures attached, representing the manufactured form which is preferable, serving as an example but not limited to that, of the present invention and in which:

BRIEF DESCRIPTION OF THE DRAWINGS

FIG. 7 shows a schematic view of the centre cross-section of another projected form of the cover with press-down opening;

FIG. 8 shows a plan of the cover of FIG. 7;

FIG. 9 shows a schematic view of the centre cross-section of a further projected form of the cover with double opening of the tab with thumb-press, as in FIGS. 7 and 8;

FIG. 10 shows in schematic form the stacking of the containers of the present invention.

DESCRIPTION OF THE PREFERRED EMBODIMENTS

Figure 1:
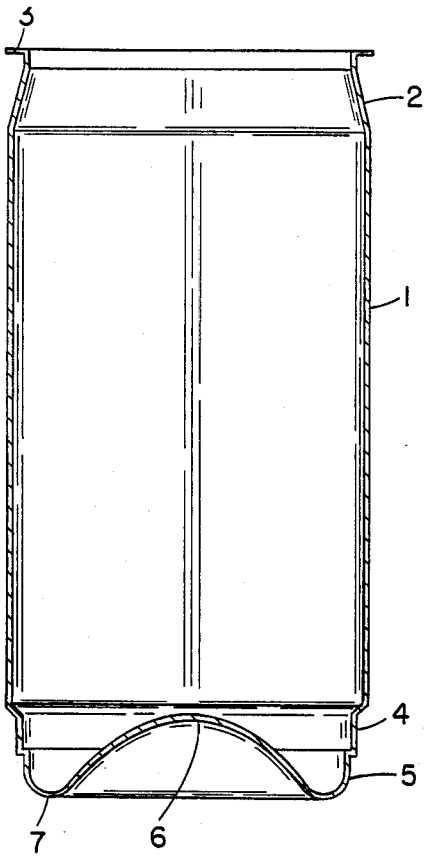
FIG. 1 shows a schematic view of the centre cross-section of a container of the present invention.

FIG. 1 illustrates a typical container (1) having cylindrical body, provided with, towards the mouth, a trunco-conical narrowing (2), from which protrudes the heat-sealed ring (3). The ring (3), thanks to the reduction of circumference, can be contained within the maximum diameter of the cylindrical body. The bottom is joined to the cylindrical body with a portion having a double-step profile (4 and 5), the first step (4) fitting into the body (1), the second one (5) fitting into the first one and joined to the balancing base (6).

This base is constructed of a cavity convex towards the centre of the container, obtained by a profile of rotation around the longitudinal axis of the container and joined to the last step (5) with a toroidal section (7) of restricted curvature. The toroidal section (7) ensures that the base remains flat (6) and acts as a fastener for the central convex wall which reversibly changes shape under load.

In this way one constructs a flat base irreversible and resistant elastically to the axial stresses from the fizzy contents, and which precludes the possibility of falling over, and conserving also the aesthetic characteristics of stability in the upright position and when in movement.

The container is made of heat-moulded plastic material, in particular of polyethylene, and preferably obtained with bidirectional pressing.

The particular configuration of the base gives to the container those elastic characteristics which allow one to obtain a spring configuration, which loaded and not overloaded during the filling phase, may gradually spring back to make up for the slight losses of compression due to losses through osmosis of the $CO_2$.

Figure 2:
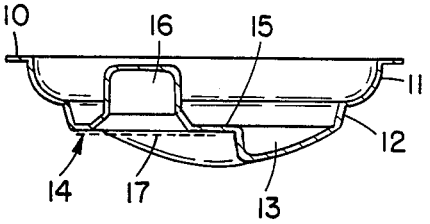
FIG. 2 shows a schematic view of the centre cross-section of a preferred form of the cover.
Figure 3:
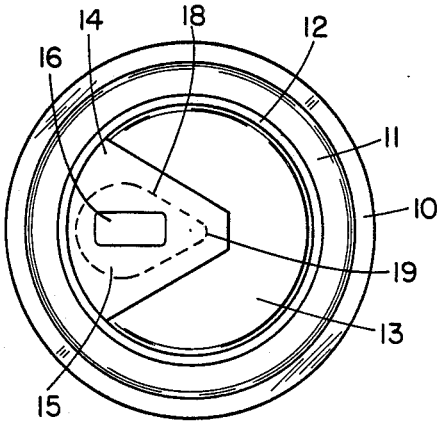
FIG. 3 shows a plan of the cover in FIG. 2.

The part with small steps 4 and 5 of the connection of the cylindrical body with the base provides, apart from stiffening, the possibility of stack one container upon the cover of another one placed underneath. According to the present invention, the cover is projected according to the logic of elastically contraopposed compressions, as illustrated in FIGS. 2 and 3. With reference to these drawings, the cover comprises a flat perimetrical ring 10 designed for heat-sealing, a convex intermediate part towards the interior comprising two small steps 11 and 12 and a central part having a crown shape 13 with the tendency to become spherical except for a flat area preferably triangular 14 placed in correspondence with the plane of the lower step 12. The flat area is intended to be the site for the flap of the pull-off opening 15. The upper step 11 has a shape complementary to the step 5 on the bottom of the container.

Figure 4:
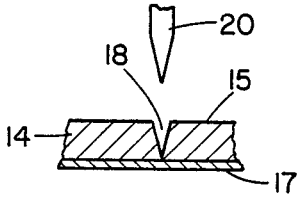
FIG. 4 shows a schematic view of the coupling of the cover with sealing film corresponding to the pull-off opening.

As illustrated in FIG. 4, the flap of the pull-off opening 15 is obtained by means of hot incision of the laminar layer by means of a shear 20 for heat incision, up to a minimal thickness the laminate 14, except the part of the apex 19. Under the same flap 15, a very thin sealing film 17 is heat-sealed on to the entire edge of the flap area 14, and is highly impermeable to gases, in particular to $CO_2$.

After the heat-sealing, effected according to well-known methods, of the ring 10 of the cover to the ring 3 of the cylindrical body, one obtains a watertight container which, thanks to the compressible spring-shape of the cover and the base, is able to withstand the stress due to variations in pressure through increase in temperature, changing shape elastically so as to compensate for the loss of pressure due to the slow osmosis of the $CO_2$. At the same time the profile allows the opening device to be contained within the limits of the coupling of the bottom of one to the top of the other during stacking, as seen in FIG. 10. The form of the cover is not completely symmetrical in the radial sense because of the presence of a flat part 14, which serves to carry the opening flap 15, the groove of which is incised along the line indicated and is protected, on the inside, by the sealing film 17.

Figure 5:
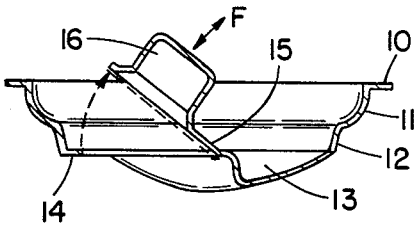
FIG. 5 shows a schematic view of the tearing off of the closure of the cover, shown in FIGS. 2 and 3.
Figure 6:
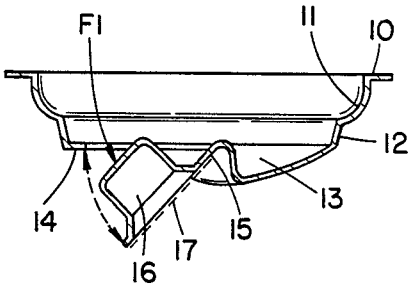
FIG. 6 shows a schematic view of the pushing down of the closure of the cover, shown in FIGS. 2 and 3.

On the flap 15 it is preferable to have a protuberance 16 obtained by heat moulding and designed for the pull-off part, which is made by traction or by pressing, as is represented in FIGS. 5 and 6. By pulling the protuberance 16 in the direction F one breaks away the flap 15 along the already incised line 18 and it rotates upon the part by the apex 19 which is intact. One variation of its use is indicated in FIG. 6, i.e. pressing upon the protuberance 16, in the direction of F1, one still breaks the sealing flap 15 along the precut line 18 and one has the bend at the area of the apex 19.

A further and different project for the opening is shown in FIGS. 7, 8 and 9. In this version, the opening flap 25, as previously produced by precutting the flat laminate 14 and with the insertion underneath this of a sealing film 17, is fixed to the flat area 14 in correspondence to the two extremes of a central line 29, with possibly slight precutting in the vicinity of the two said extremes. In this way, the flap is divided into two parts 25 and 25', hinged along the central line 29 where they are fixed. The two parts 25 and 25' can, by pressure according to the direction of the arrows F2 and F3, be opened downwards, as shown in fact in FIG. 9.

In this way, from the orifice created by pushing down part 25, the liquid flows out, while into the orifice created by pressing down part 25', the air enters, so that the jet of liquid comes out continuously and without stops and starts.

I claim:

1. A container for a fizzy liquid drink made of polyethylene or polyethylene terephthalate which comprises a heat-sealed cover, a body, a base (6) a pull-off tab, said cover and said base having a convex profile towards the interior of said container and being capable of elastically changing shape under the pressure from the liquid contained therein; said base and said cover having a convex part of a profile essentially of a spherical crown, wherein said convex part of said base is of diameter smaller than the diameter of the body of said container and is connected to said body by means of a portion having the profile of an upper step (4) and a lower step (5), the convex part of said base being connected to the lower step (5) by means of a toroidal area (7) of small curvature, wherein the convex part (13) of said cover is attached to the body of the container by means of an intermediate portion convex towards the interior of the container and having a profile with one upper step (11) and one lower step (12), said cover being attached to the body of the container by means of a flat perimetrical sealing ring (10), wherein said upper step (11) has a form complementary with said step (5) and wherein the convex part (13) of the cover has a flat area (14) in the plane of the lower step (12), said flat area being the site of said pull-off tab.

2. The container according to claim 1 wherein said flat area (14) is triangular, said triangular area has an apex (19), said tab (15) is produced by heat-incision of said flat area (14) along a pre-cut line (18), except for said apex (19) and a sealing film (17) is heat-pressed under said tab (15).

3. The container according to claim 2 wherein said tab (15) is provided with a protuberance (16).

4. The container according to claim 1 wherein said tab is fixed to the said area (14) at two opposite points of a central line (29), and is divided into two parts (25 and 25').

* * * * *